United States Patent [19]

Louez

[11] Patent Number: 4,796,888

[45] Date of Patent: Jan. 10, 1989

[54] HUE SEQUENCE DEVICE

[76] Inventor: Nigel Louez, 111 Belmont Road, Mosman, New South Wales 2088, Australia

[21] Appl. No.: 885,609

[22] PCT Filed: Oct. 23, 1985

[86] PCT No.: PCT/AU85/00254

§ 371 Date: Jun. 17, 1986

§ 102(e) Date: Jun. 17, 1986

[87] PCT Pub. No.: WO86/02569

PCT Pub. Date: May 9, 1986

[30] Foreign Application Priority Data

Oct. 23, 1984 [AU] Australia ..... PG7780
Nov. 26, 1984 [AU] Australia ..... PG8288

[51] Int. Cl.[4] ..... A63B 41/00; A63B 41/08; A63H 33/04

[52] U.S. Cl. ..... 273/58 R; 273/65 R; 40/327; 272/8 N; 272/8 D; 434/403; 434/98; 434/104

[58] Field of Search ..... 40/327; 434/98, 104, 434/403, 101; 273/58 R, 65 R

[56] References Cited

U.S. PATENT DOCUMENTS 1,178,361 4/1916 Van Sciver ..... 40/327
3,726,027 4/1973 Cohen et al. ..... 434/98

OTHER PUBLICATIONS

"The Basic Law of Color Theory" by Harald Kueppers, Published in 1982, Barron's, New York, pp. 69–101, 167–186 and FIGS. 1–47.

*Primary Examiner*—George J. Marlo
*Attorney, Agent, or Firm*—Ladas & Parry

[57] ABSTRACT

A novelty item comprising a sphere, sphereoid or polyhedron. The surface of the novelty item is divided into a plurality of differently colored areas with the sum of the areas constituting the surface of the item. The size and shaped of all the areas is approximately the same and the color of any one area and the color of the adjacent areas are spectrally related having an angular spacing on the color wheel corresponding to the angular spacing between the normals to each of the areas passing through the center of the novelty item. Also, a color mapping method from the two dimensional color wheel to a three dimensional color wheel.

22 Claims, 7 Drawing Sheets

HUE SEQUENCE DEVICE

TECHNICAL FIELD

The present invention relates to a method of, and means for, obtaining colour effects by relative movement of a hue sequence. The invention is particularly applicable, for example, to toys, especially balls.

BACKGROUND ART

Multi-coloured objects are known, particularly in relation to toys and educational aids. For example, multi-coloured beach balls are known in which the surface is divided into segmented areas which are randomly coloured. Other known multi-coloured objects include devices similar to the Rubic cube and other Pythagorean solids useful for teaching purposes—that is polyhedrons with pentagonal, heptagonal or other regular sized facets. Typically, colour is applied to the surfaces of such objects as listed above merely in order to allow differentiation between component parts or surfaces. The colours in such cases are not chosen with a view to producing any particular visual effect when the objects are rotated in or when relative movement of the colours with respect to the eye is otherwise brought about.

Similarly, it is known to apply a black and white pentagonal pattern to soccer footballs but the ball produces no interesting colour effect when it rotates.

It is also known that presentation of the primary colours to the eye in sequence at an appropriate rate of exposure will result, by virtue of persistence of vision or speed colour mixing, in a summation of the colours such that the total appears a uniform colour, such as white or neutral grey, to the eye. This is the basis of a colour disc device divided into sectors which are coloured with the various colours of the rainbow. When spun the disc appears white or neutral grey.

Thus, the eye catching effect of colour, the effects of eye colour selectivity and the effect of persistence of vision or speed colour mixing, have each been exploited in various ways by the prior art. However, the above features and effects have not heretofore been combined in a selective manner to produce an object which, upon relative motion of its coloured surfaces relative to the eye produces a pleasing, consistent and attractive colour effect.

It is an object of the present invention to provide for the application of a hue sequence to the surface areas of a sphere, spheroid or polyhedron which will result in a visually pleasing novelty item.

DISCLOSURE OF INVENTION

According to the present invention there is provided a novelty item comprising a sphere, spheroid or polyhedron, the surface of which is divided into a plurality of differently coloured areas, the sum of said areas constituting said surface, the size and shape of all said areas being approximately the same, each area having a normal extending radially outwardly from the centre of said sphere, spheroid or polyhedron through approximately the centre of said area, the angle between adjacent ones of said normals being 360° divided by the number of said areas, the colours of adjacent areas being selected from a pair of colours which differ by said angle on a colour wheel on which two spectrally opposite colours differ by 180°, and each area lying on a sequential colour path comprising the sequence of said selected colours progressing around said colour wheel.

BRIEF DESCRIPTION OF THE DRAWINGS

Some embodiments of the present invention will now be described with reference to the drawings in which.

MODE OF CARRYING OUT THE INVENTION

Figure 1:
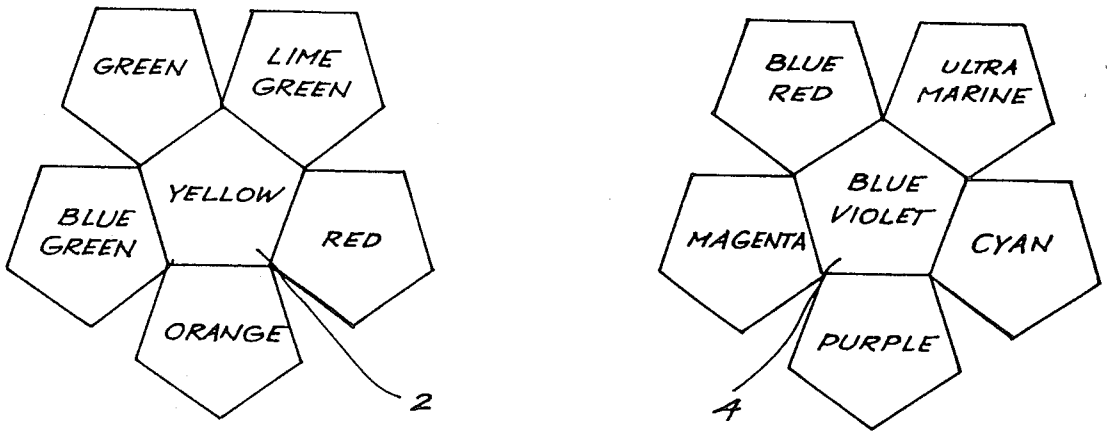
FIG. 1 schematically represents the plan and inverted plan views of a dodecahedron having 12 pentagonal areas, each of different colour, the yellow area 2 being on "top" and the blue violet area 4 being on the "bottom"
Figure 2:
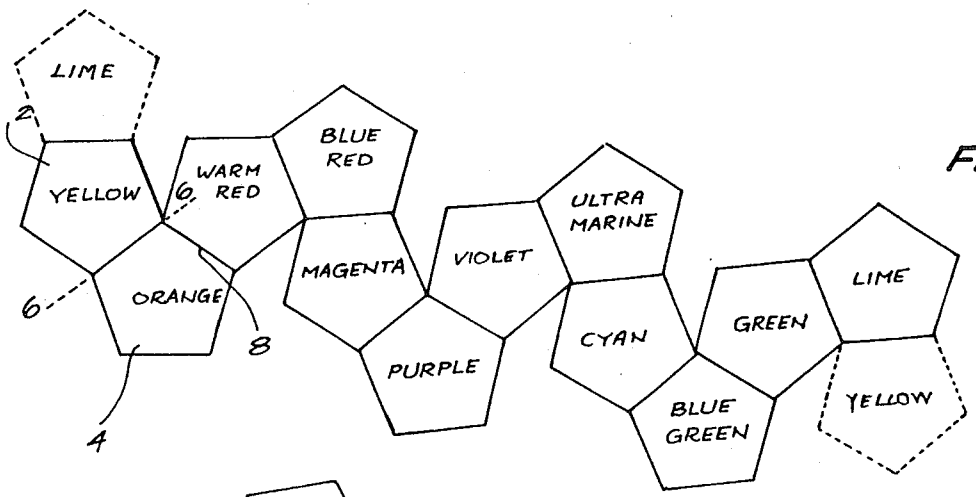
FIG. 2 illustrates the segmential colour path, or juxtapositition, (i.e. which colours are arranged adjacent to each other and their total sequence) for the object of FIG. 1.
Figure 3:
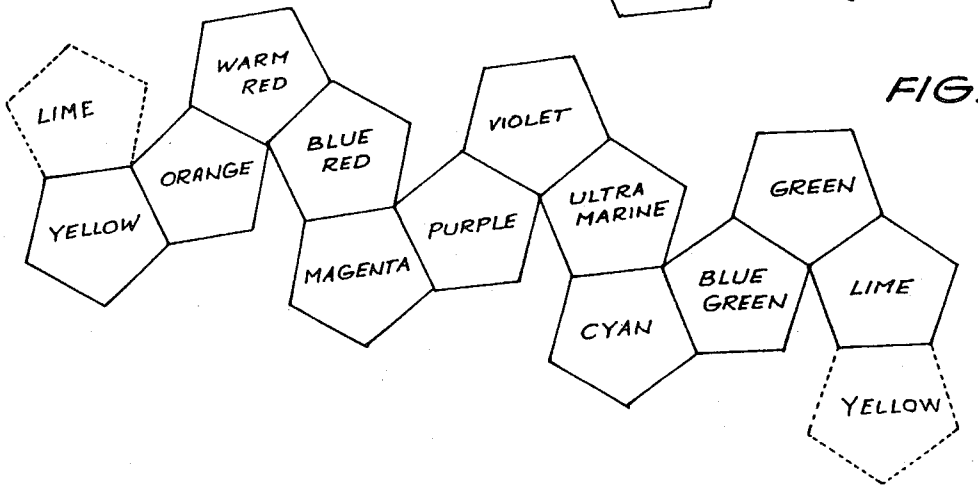
FIG. 3 depicts another allowable relationship between the colours for the object of FIG. 1 commencing with a different angular disposition between the pentagonal hue areas.

In a first embodiment there is provided a dodecahedron (a polyhedron which has 12 equal areas) in which the twelve equal surfaces are of different hue as illustrated in FIGS. 1–3. The different hues or colours are distributed over the surface such that areas diametrically opposite each other are of hues which are spectrally opposite.

"Spectrally opposite" colours are defined as those colours which appear opposite each other on the known colour wheel. The term "spectrally opposite" is used in a broad sense and is applicable to any one of the additive, partative or subtractive colour wheels. In this connection the reader is referred to the entry under "color" or "colour" in Webster's 3rd New International Dictionary.

Figure 7:
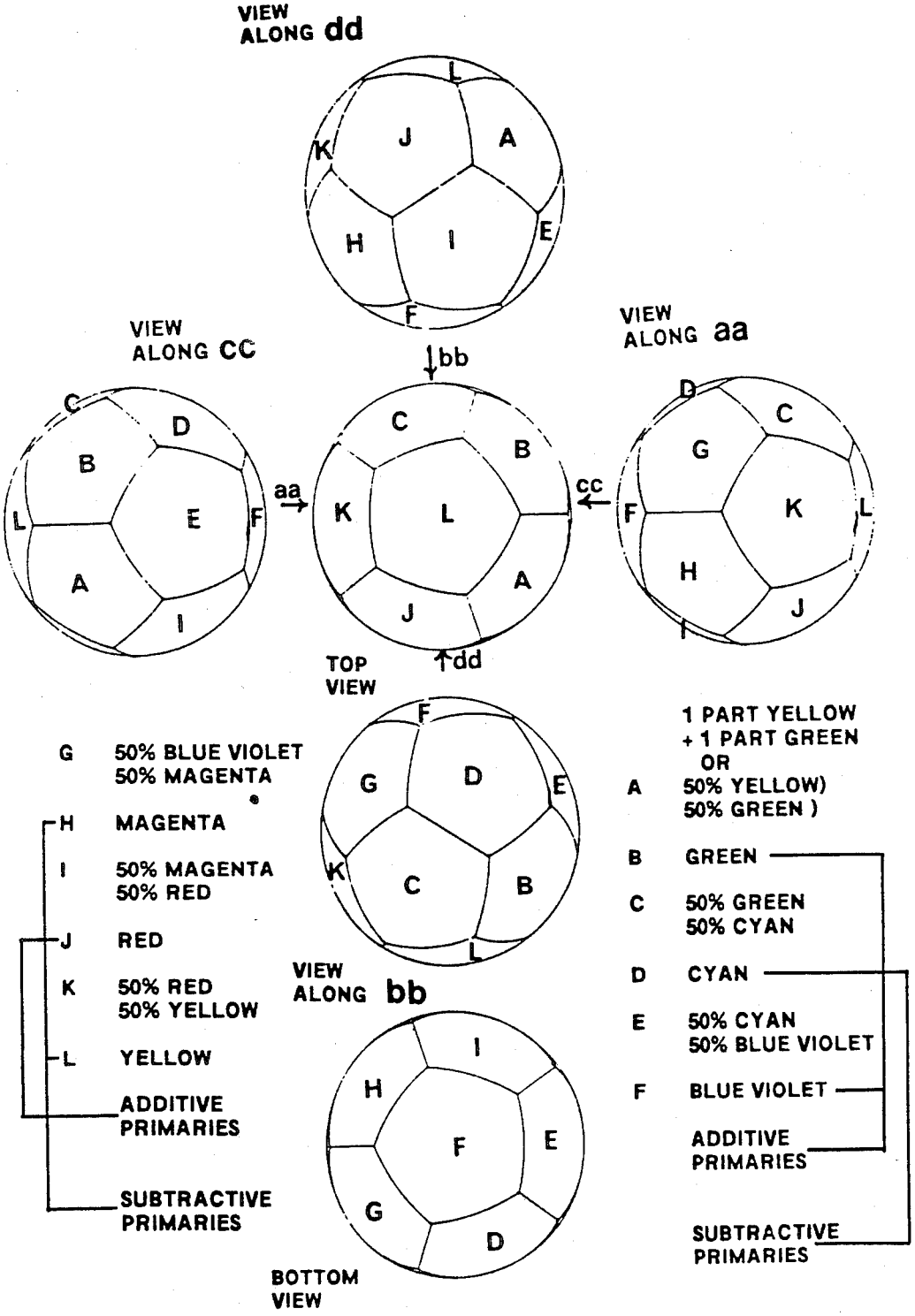
FIG. 7 illustrates six views of a spherical ball to which the colour areas of FIG. 1 has been applied by distorting the flat areas of FIG. 1 to cover an equivalent curved surface, thereby converting a dodecahedron into a sphere.

In the first embodiment the colour sequence can be applied either to a dodecahedron as illustrated in FIGS. 1 to 3, or as illustrated in FIG. 7, to the spherical surface of a ball. The ball can be of any suitable material, typically a plastic material which allows for a ball which can be bounced and has a deflectable surface thus adding further appeal to the item. The diameter of such a ball can be any convenient dimension concomitant with its expected use as a novelty item capable of being spun by hand or by mechanical means and can be in the range of 4 to 30 cm but is not necessarily limited thereto.

Referring now to FIG. 1, a pentagonal area or surface facet of the dodecahedron of yellow colour is selected as a pole 2. The spectrally opposite colour is blue violet which occupies the opposite pole 4. The yellow pole 2 is surrounded by the five hues indicated. The violet pole 4 is surrounded by the five hues indicated. The edges of the pentagons abut at the "equator" of the dodecahedron such that the cyan hue touches both the blue-green and green hue.

FIG. 2 depicts a hue sequence, sequential colour path or spectral order for the colours comprising the object of FIG. 1 showing a juxtaposition of pentagonal coloured shapes according to the first embodiment. The hue sequence or chain is such that the yellow pentagon 2 is joined to a warm orange pentagon 4 about an axis of symmetry 6—6. The orange pentagon 4 is joined to a warm red pentagon along an adjacent side 8. The sequence of colours is continued through the spectral sequence as indicated resulting in spectrally opposite colours being an opposite surface when the structure is formed into a 3D object.

In FIG. 3 the initial yellow pentagon 2 is turned through 180° which alters the shape of the chain of abutted pentagons. The hue sequence of colours is however maintained.

FIGS. 2 and 3 illustrate spectral orders commencing with the colour yellow. However, any one of the nominated colours in FIGS. 1 to 3 can be used as the starting colour providing that the juxtaposition is maintained, i.e. the colours can be shifted along the chain providing order is maintained. This is indicated by the dotted lime and yellow pentagons in FIGS. 2 and 3. Thus the sequence forms an endless loop.

Figure 4:
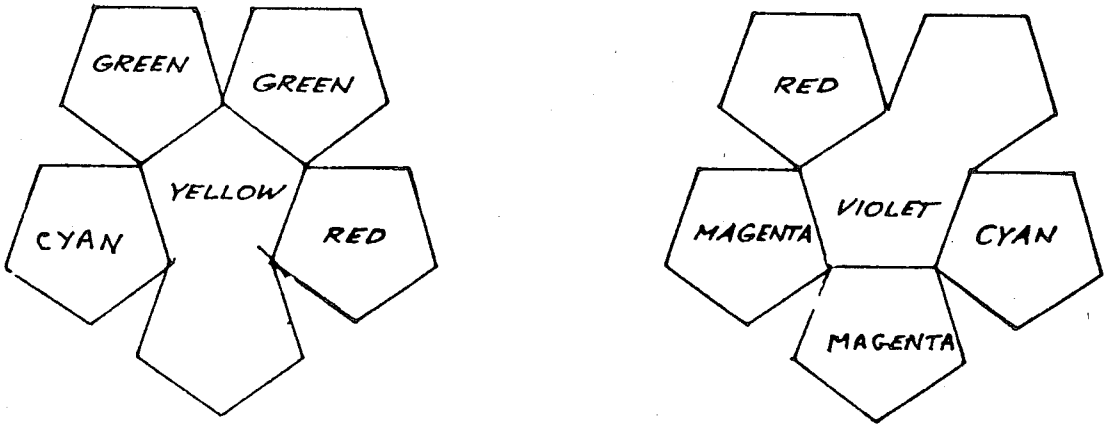
FIG. 4 is an illustration similar to that of FIG. 1 but representing the plan and inverted plan views of a dodecahedron having 6 coloured areas each of which is made up from 2 pentagonal areas, FIG. 5 and 6 correspond to FIGS. 2 and 3 but illustrate the colour sequences for the object created from the pattern of FIG. 4.
Figure 5:
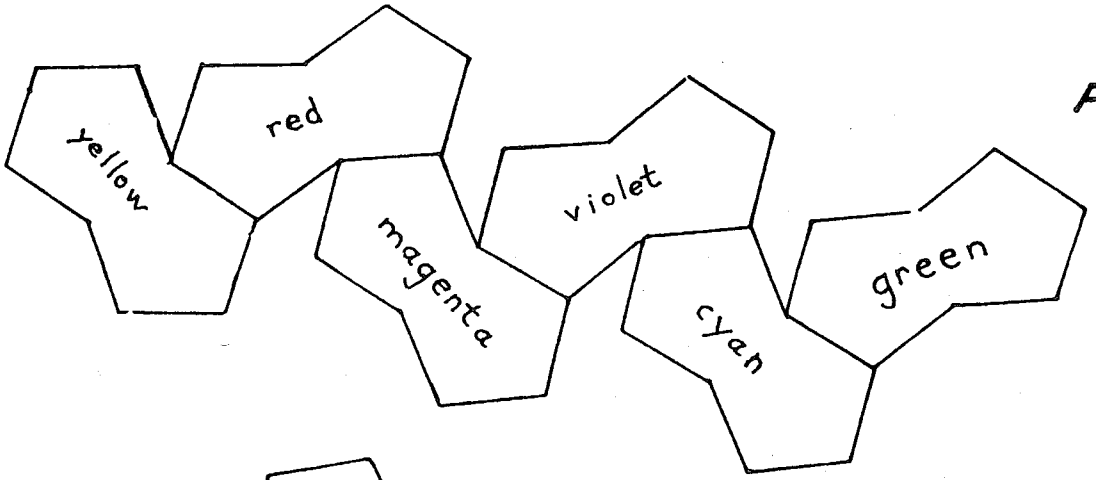
Figure 6:
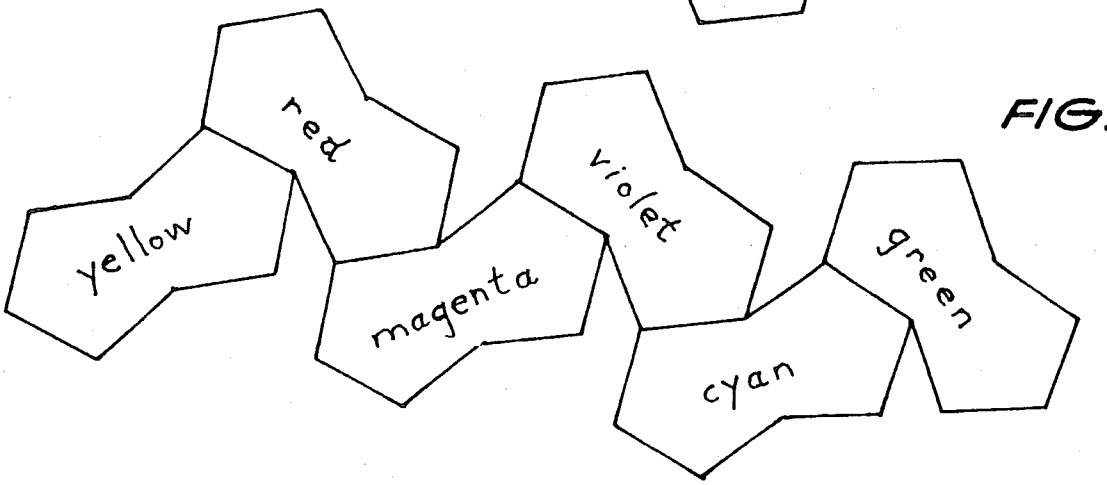

FIGS. 4 to 6 correspond to FIGS. 1 to 3 but for a dodecahedron having 12 faces or surfaces but only 6 different coloured areas. Each coloured area is formed from two abutting pentagons. The colour sequence is yellow, red, magenta, violet, cyan and green.

FIG. 7 illustrates six views of a spherical ball to which the colour areas of FIG. 1 have been applied by distorting the flat areas of FIG. 5 to cover an equivalent curved surface, thereby converting a dodecahedron into a sphere. To obtain the best effect, all hues should be a saturated maximum hue or alternatively have the same pastel value or saturation or any tint or shade thereof or a combination thereof.

In use, the ball of FIG. 4 is rotated about an axis selected at random and, dependent upon the actual speed of rotation, a pleasing optical effect can be observed. Typically, a clean mix of colours is observed radially from the pole. Hues at the poles have a clean appearance. Closer to the equator, a strobing effect is obtained. This is caused by the presentation of alternating spectrally opposite colours and values being presented to the eye in rapid sequence. At higher speeds, the strobing effect presents as a glow of colour around the circumference at the equator.

For the twelve segment body, there can be defined a neutral axis wherein the neutral axis is defined as an axis thruogh the centre of the twelve segment body and through a point on the surface which is a junction point of a triadic colour combination. A triadic colour combination is defined as a set of three colours picked from points located at equal spacings around the colour wheel. Note also that any additive triad set would combine to give white and any subtractive triad set would combine to give neutral grey. If the sphere is spun on a neutral axis the entire surface of the sphere blends to an overall even, neutral tone.

Figure 8:
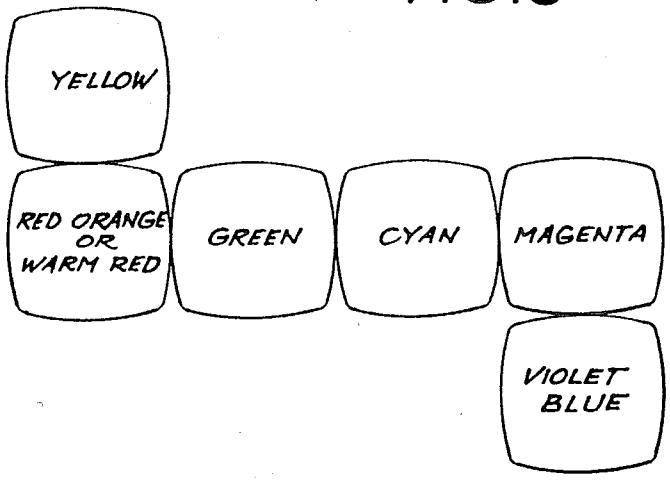
FIG. 8 illustrates a hue sequence similar to FIG. 2, but for an object having six faces, each outwardly curved and of equal area. Thus, the object of FIG. 5 represents a bloated cube or cubic spheroid.

FIG. 8 illustrates a further embodiment in which the solid object comprises a six sided figure in which each "side" is a curved surface. Thus the object schematically represented in FIG. 8 constitutes a "bloated cube" or cubic spheroid. Again each of the surfaces is of substantially equal area and shape. The method of selection of the colours will now be described with reference to FIGS. 9 to 11.

Figure 9:
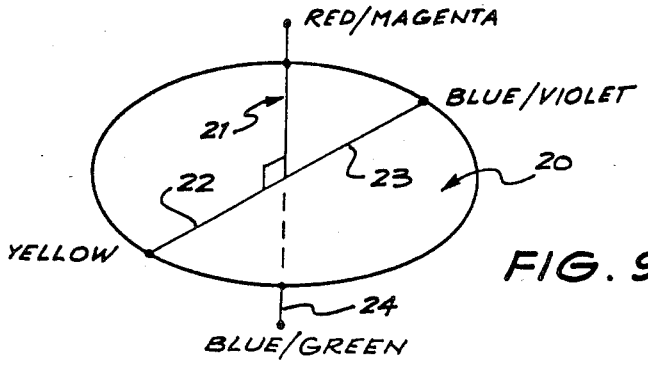
FIG. 9 illustrates the normals extending radially from the centre of a novelty item having 4 coloured areas.

FIG. 9 illustrates a reference plane 20 passing through the centre of a solid, for example, a sphere which is not illustrated. On the surface of the sphere are four coloured areas each of which has a normal 21, 22, 23, or 24 passing from the centre of the coloured area to the centre of the sphere. The angle between each normal (say 21) and the adjacent normal (either 22 or 23) is 360° divided by 4 areas or 90°. The colour of each of the four areas is as illustrated. The angle of 90° determines the colour of the remaining 3 areas once the colour of one of the areas has been selected. This will be explained in relation to FIG. 11.

Figure 10:
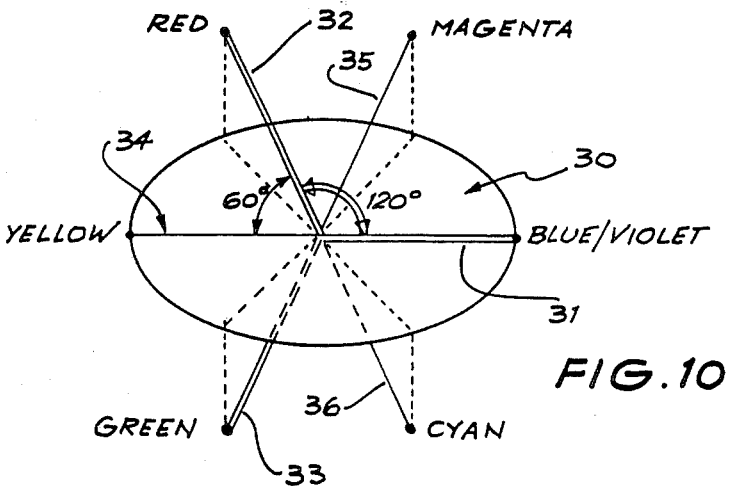
FIG. 10 illustrates the normals extending radially from the centre of a novelty item having 6 coloured areas, and, FIG. 11 illustrates a colour wheel.

FIG. 10 is an illustration similar to that of FIG. 9 but for an object having six coloured surfaces such as the dodecahedron of FIGS. 4 to 6. Again a reference plane 30 passes through the centre of the dodecahedron (which is not illustrated). The six coloured areas on the bloated cube each have a normal 31 to 36 respectively passing from the centre of the coloured area (i.e. the midpoint of the dividing line between the two pentagons of each area) to the centre of the sphere. The angle between each pair of the normals 31 and 32; 32 and 33 and 33 and 32 is 120° whilst the angle between adjacent normals e.g. 32 and 34 is 360° divided by 6 areas equals 60°. The colour of each area is as indicated.

Figure 11:
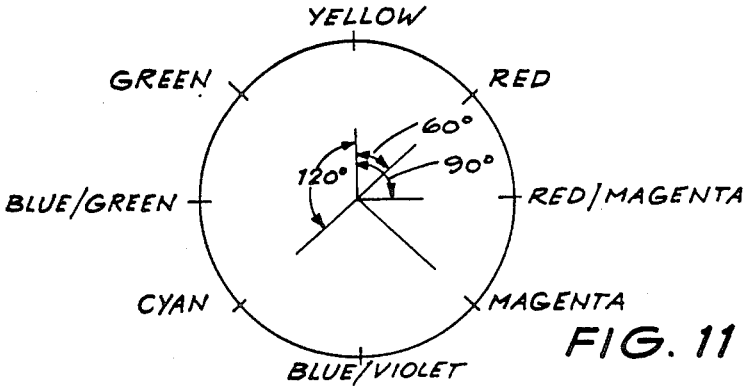

Turning now to FIG. 11, a conventional colour wheel is illustrated. From the angles determined by the geometric concepts illustrated in FIGS. 9 and 10, the colours of the various areas selected can be determined using the colour wheel of FIG. 11. In this connection the colour of a first one of the coloured areas can now be selected without restraint.

If yellow is selected for the first area (normal 34) then the second area colour for FIG. 10 is selected by progressing around the colour wheel in either direction by 60° until, say, red is reached. This then determines the colour for the area having normal 32. Continuing now in the same direction around the colour wheel by 60° increments the colours thus determined for the areas which correspond to normals 35, 31, 36 and 53 are magenta, blue/violet, cyan and green.

Similarly, for the four coloured areas of the arrangement of FIG. 9, if yellow is again selected as a starting colour for the area corresponding to normal 22, the progressing (this time in the opposite direction) around the colour wheel yields blue/green for the area of normal 24, blue/violet for the area of normal 23 and red/magenta for the area of normal 21.

It will be apparent to those skilled in the colour art that any location or colour on the colour wheel can be selected as an intial colour but thereafter the colours are determined. Preferably the colours are arranged so that primary colours in the main are selected.

The following table gives the areas, angles and a typical colour sequence for a number of cases including the trivial examples of 2, 3, and 4 areas.

| Areas | Angle | Colour Sequence |
|---|---|---|
| 2 | 180 | Green, Magenta |
| 3 | 120 | Yellow, magenta, cyan |
| 4 | 90 | Yellow, red/magenta, blue/violet, blue/green |
| 5 | 72 | Red, yellow, green, blue, purple |
| 10 | 36 | Red, yellow/red, yellow, green/yellow, green, blue/green, blue, purple/blue, purple, red/purple |

If desired the coloured areas can be surrounded by either white, black or neutral tone borders. Pleasing effects are achieved where the colours used are fluorescent colours.

Further, the size of the coloured areas is preferably in proportion to the size of the structure to which they are applied. In this connection one should bear in mind the expected speed of rotation of the object, and the human eye's characteristics of persistence of vision and colour sense. These characteristics operate so as to achieve the desired pleasing effect. This typically requires a minimum speed threshold to be passed in order that the blend effect be observed.

The coloured areas can be any regular shape, the shape being such that each edge of each shape abutts against a corresponding edge of the adjacent shapes when applied to a sphere, spheroid or polyhedron.

However, these shapes can be irregular, providing that an average surface balance of area is maintained.

Further a given area segment can comprise two colours each taking up, for example, half of the total area such that the "average" colour within the total segment is the required colour wheel colour to match with the geometric arrangement of the novelty item.

Further, although FIGS. 2 and 3 illustrate one particular spectral sequence with 12 equal colour areas, other spectral sequences can be created to achieve similar results for solid figures with, for example, 3, 4, 5 or 20 aproximately equal surface colour areas.

The foregoing describes only some embodiments of the present invention and modifications, obvious to those skilled in the art, can be made thereto without departing from the scope of the present invention.

I claim:

1. A novelty item capable of producing variable axis colour mixing, said novelty item comprising: a sphere, spheroid or polyhedron capable of spinning freely and randomly upon many axes of spin when spun on a generally planar surface, the whole exterior surface of said sphere, spheroid or polyhedron being divided into a plurality of generally equally sized and generally equally shaped coloured areas, said axes including both neutral and non-neutral axes, a neutral axis being an axis passing through the center of said sphere, spheroid or polyhedron and through a point on the surface of said sphere, spheroid or polyhedron which is a function point of a triadic colour combination, a triadic colour combination being a set of three of said coloured areas having colours selected from points located at equal spacings around a 2D colour wheel; said coloured areas being coloured according to a 2D to 3D colour mapping scheme wherein no two adjacent one of said coloured areas are of the same colour and the colour of each one of said coloured areas is selected such that any two of said coloured areas which are respectively coloured with colours which are at a maximum distance from each other on the 2D colour wheel with respect to any other colour on the 2D colour wheel are also at a maximum distance, measured across the exterior surface of said sphere, spheroid or polyhedron, from each other with respect to any other of said coloured areas on said sphere, spheroid or polyhedron; said mapping scheme providing an inherent infinite plurality of non-neutral and an inherent finite plurality of neutral axes of spin of said sphere, spheroid or polyhedron; whereby when said sphere, spheroid or polyhedron is randomly spun on any one of said infinite plurality of non-neutral axes a clean mix of colours near the poles and a strobing effect of colours at the equator is presented to an observer, the detailed colour composition of which varies as the axis of spin varies; said sphere, spheroid or polyhedron when randomly spun on one of said finite number of neutral axes presenting to an observer an overall even, neutral tone; said sphere, spheroid or polyhedron spinning on a planar surface continually and randomly varying its axis of spin so that said sphere, spheroid or polyhedron spins successively upon a multiplicity of the infinite plurality of non-neutral axes interspersed with the occasional spin on ones of said finite number of neutral axes.

2. The novelty item of claim 1 wherein the number of areas equals six, three of said areas being coloured by the subtractive primary cyan, magenta and yellow respectively, the three remaining areas being coloured by the additive primary colours blue/violet, red and green respectively, and the spectrally opposite ones of said primary colours being located on radially opposite areas.

3. The novelty item of claim 2 wherein said areas are substantially square.

4. The novelty item of claim 3 wherein the item is a cubic spheroid comprising a bloated cube.

5. The novelty item of claim 1, wherein said areas number twelve and comprise two groups of six colours being a first group having a polar center of yellow hue surrounded by green, lime-green, red, orange and blue-green and a second group having a polar center of blue-violet surrounded by blue-red, ultra-marine, cyan, purple and magenta with the cyan colour of the first group adjoining the green colour of the second group.

6. The novelty item of claim 5 wherein said areas are substantially pentagonal.

7. The novelty item of claim 6 wherein the item is a dodecahedron.

8. The novelty item of claim 6 wherein the item is a sphere.

9. The novelty item of claim 1 wherein the hues are selected from the group consisting of saturated maximum hues and pastel hues.

10. The novelty item of claim 9 wherein the hues are selected from more than one member of the group consisting of saturated maximum hues or any tint or shade thereof.

11. The novelty item of claim 1 wherein a white border surrounds each said equal area.

12. The novelty item of claim 1 wherein a black border surrounds each said equal area.

13. The novelty item of claim 1 wherein a grey border surrounds each said equal area.

14. A method of producing variable axis colour mixing by providing a sphere, spheroid or polyhedron; randomly spinning said sphere, spheroid or polyhedron on a planar surface; said sphere, spheroid or polyhedron being capable of spinning freely and randomly upon many axes of spin; the whole exterior surface of said sphere, spheroid or polyhedron being divided into a plurality of generally equally sized and generally equally shaped coloured areas; said axes including both neutral and nonneutral axes, a neutral axis being an axis passing through the center of said sphere, spheroid or polyhedron and through a point on the surface of said sphere, spheroid or polyhedron which is a junction point of a triadic colour combination, a triadic colour combination being a set of three of said coloured areas having colours picked from points located at equal spacings around a 2D colour wheel; said coloured areas being coloured according to a 2D to 3D colour mapping scheme wherein no two adjacent ones of said coloured areas are of the same colour and the colour of each one of said coloured areas is selected such that any two of said coloured areas which are respective coloured with colours which area at a maximum distance from each other on the 2D colour wheel with respect to any other colour on the 2D colour wheel are also at a maximum distance, measured across the exterior surface of said sphere, spheroid or polyhedron, from each other with respect to any other of said coloured areas on said sphere, spheroid or polyhedron; said mapping scheme providing an inherent infinite plurality of non-neutral and an inherent finite plurality of neutral axes of spin of said sphere, spheroid or polyhedron; whereby when said sphere, spheroid or polyhedron is randomly spun on any one of said infinite plurality of non-neutral axes a clean mix of colours near the poles and a strobing effect of colours at the equator is presented to an observer, the detailed colour composition of which varies as the axis of spin varies; said sphere, spheroid or polyhedron when randomly spun on one of said finite number of neutral axes presenting to an observer an overall even, neutral tone; said sphere, spheroid or polyhedron when spun on a planar surface continually and randomly varying its axis of spin so that said sphere, spheroid or polyhedron spins successively upon a multiplicity of the infinite plurality of non-neutral axes interspersed with the occasional spin on one of said finite number of neutral axes.

15. The method of claim 14 wherein the number of areas equals six, three of said areas being coloured by the subtractive primary colours cyan, magenta and yellow respectively, the three remaining areas being coloured by the additive primary colours blue/violet, red and green respectively, and the spectrally opposite ones of said primary colours being located on radially opposed areas.

16. The method of claim 14 wherein said areas number twelve and comprise two groups of six colours being a first group having a polar center of yellow hue surrounded by green, lime-green, red, orange and blue-green and a second group having a polar center of blue-violet surrounded by blue-red, ultra-marine, cyan, purple and magenta with the cyan colour of the first group adjoining the green colour of the second group.

17. The method of claim 14 wherein the hues are selected from the group consisting of saturated maximum hues and pastel hues.

18. The method of claim 17 wherein the hues are selected from more than one member of the group consisting of saturated maximum hues or any tint or shade thereof.

19. The method of claim 14 wherein a white border surrounds each said equal area.

20. The method of claim 14 wherein a black border surrounds each said equal area.

21. The method of claim 14 wherein a grey border surrounds each said equal area.

22. A method of producing variable axis colour mixing by providing a sphere, spheroid or polyhedron; randomly spinning said sphere, spheroid or polyhedron on a planar surface, said sphere, spheroid or polyhedron being capable of spinning freely and randomly upon many axes of spin; the whole exterior surface of said sphere, spheroid or polyhedron being divided into a plurality of generally equal sized and generally equally shaped coloured areas; said axes including both neutral and nonneutral axes, a neutral axis being an axis passing through the center of said sphere, spheroid or polyhedron and through a point on the surface of said sphere, spheroid or polyhedron which is a junction point of a triadic colour combination, a triadic colour combination being a set of three of said coloured areas having colours picked from points located at equal spacings around a 2D colour wheel; said coloured areas being coloured according to a 2D to 3D colour mapping scheme wherein no two adjacent ones of said coloured areas are of the same colour and the colour of each one of said coloured areas is selected such that any two of said coloured areas which are respectively coloured with colours which are at a maximum distance from each other on the 2D colour wheel with respect to any other colour on the 2D colour wheel are also at a maximum distance, measured across the exterior surface of said sphere, spheroid or polyhedron, from each other with respect to any other of said coloured areas on said sphere, spheroid or polyhedron; said mapping scheme providing an inherent infinite plurality of non-neutral and an inherent finite plurality of neutral axes of spin or said sphere, spheroid or polyhedron; randomly spinning said sphere, spheroid or polyhedron on any one of said infinite plurality of non-neutral axes presenting to an observer a clean mix or colours near the poles and a strobing effect of colours at the equator, the detailed colour composition of which varies as the axis of spin varies; said sphere, spheroid or polyhedron when randomly spun on one of said finite number of neutral axes presenting to an observer an overall even, neutral tone; said sphere, spheroid or polyhedron when spun on a planar surface continually and randomly varying its axis of spin so that said sphere, spheroid or polyhedron spins successively upon a multiplicity of the infinite plurality of non-neutral axes interspersed with the occasional spin on ones of said finite number of neutral axes.

* * * * *